US008499376B2

(12) United States Patent
Kyung Kim

(10) Patent No.: US 8,499,376 B2
(45) Date of Patent: Aug. 6, 2013

(54) DRAIN PLUG

(76) Inventor: Tae Kyung Kim, Troy, MI (US)

( * ) Notice: Subject to any disclaimer, the term of this patent is extended or adjusted under 35 U.S.C. 154(b) by 419 days.

(21) Appl. No.: 12/964,226

(22) Filed: Dec. 9, 2010

(65) Prior Publication Data

US 2012/0097679 A1 Apr. 26, 2012

(30) Foreign Application Priority Data

Oct. 26, 2010 (KR) ..... 10-2010-0104679

(51) Int. Cl.
*E03C 1/23* (2006.01)

(52) U.S. Cl.
USPC ..... 4/689; 4/287; 4/295

(58) Field of Classification Search
USPC ..... 4/688, 689, 287, 295
See application file for complete search history.

(56) References Cited

U.S. PATENT DOCUMENTS

| | | | | |
|---|---|---|---|---|
| 3,428,295 | A * | 2/1969 | Jones et al. | 4/295 |
| 4,860,390 | A * | 8/1989 | Ohta | 4/295 |
| 6,195,819 | B1 * | 3/2001 | Wang | 4/689 |

FOREIGN PATENT DOCUMENTS

| | | |
|---|---|---|
| EP | 1568823 | 8/2005 |
| JP | 52068563 | 6/1977 |
| JP | 11293734 | 10/1999 |
| KR | 2019890013418 | 8/1989 |
| KR | 200273579 | 4/2002 |
| KR | 1020100106861 | 10/2010 |

OTHER PUBLICATIONS

International Search Report for PCT/KR2011/008025, dated May 16, 2012 with English translation.

* cited by examiner

*Primary Examiner* — Tuan N Nguyen
(74) *Attorney, Agent, or Firm* — Young Basile Hanlon & MacFarlane PC; Denise M. Glassmeyer

(57) ABSTRACT

A drain closure device for a vessel having an interior surface and a drain hole defined in the interior surface. The drain closure device includes a drain plug configured to be telescopically received in the central throughshaft defined in the insert sleeve. The drain plug is moveable between a first contacted ceiling position and a second expanded, drain position. The drain plug includes a seal member that is attached to the first end and a connection member located on a second end. The connection member is configured to releasably engage with at least one lateral shoulder or a suitable lateral projection member associated with the drain opening when the drain plug the use position.

21 Claims, 14 Drawing Sheets

DRAIN PLUG

CROSS-REFERENCE TO RELATED APPLICATIONS

This application claims the benefit of priority under Korean Patent Application No. 10-2010-0104679, filed on Oct. 26, 2010 in the Korean Intellectual Property Office, the disclosure of which is incorporated herein by reference in its entirety.

FIELD OF THE INVENTION

This invention relates to drain plugs.

BACKGROUND

Various drain plug configurations have been proposed for sinks, tubs and the like. Certain popular types of drain plug configurations utilize various types of lever arms and the like configured to urge the drain plug member into and out of sealing engagement with a suitable mating surface. Other types of drainplug configurations utilize a "pop-up" mechanism that permits a plug device located in position in a suitable drain to move between a closed and sealed position that retains water in the tub, sink or suitable vessel and an open position that permits fluid to pass through the drain opening. The pop-up mechanism can have a suitable actuator that includes one or more biasing means. The biasing means can either be positioned to maintain the seal mechanism in the closed position, to maintain the seal mechanism in the open position or multiple biasing means can be used to accomplish both activities.

Typically, the "pop-up" device is configured such that pressure on an upper surface of the moveable member of the device causes the upper portions of the drain plug body to compress a suitable seal in to position relative to an associate surface of the affected drain. Additional or subsequent pressure on the top surfaces of the device trigger the release of the suitable biasing means and the actuation of a counter biasing means that causes the upper body of the device to raise "pop-up" and the associated seal to be removed from contact with the associated sealing surface.

The "pop-up" top device is favored in many applications because the resulting mechanism presents a clean ascetically pleasing surface and permits the drain plug member to remain anchored or associated in the drain so that it may not be misplaced. Additionally, the configuration of the pop-up device typically permits one-handed use and eliminates the need for complex lift mechanisms and lever arms that can freeze or break.

This type of device is not without drawbacks. Among the drawbacks are the difficulties encountered in removing the device from engagement with the associated drain in the event that repair is required. Typically, the pop-up device includes a central screw that must be fastened to an associated mounting spider located in the drain. The central screw must be loosened in order to disengage the moveable plug member from the drain. Over time the screw head becomes marred and degraded, making it difficult to remove the device as needed. Also, removal and reinsertion comes with the risk of cross threading that can destroy the maidenly threaded surface on which the moveable plug member is fastened.

Because of the configuration of the conventional pop-up devices, the mechanism is prone to clogging. This is particularly problematic when used in tub drains associated with shower heads and/or sink drains in which users wash their hair. Over time, hair accumulates around the pop-up drain mechanism and the spider impeding the free flow of water through the open drain. This necessitates removal of the plug member and manual removal of any hair, soap particles or other material that has accumulated on and around the spider.

Thus, it would be desirable to provide a drain closure device having a drain plug member that can be readily and effectively removed from engagement in the drain as desired or required. It is also desirable to provide a drain closure device that can provide effective and efficient removal with associated cleaning action for either pop up type devices or devices not so configured.

SUMMARY

Disclosed herein is a drain closure device for a vessel that has an interior surface and a drain hole defined in the interior surface. The drain closure device includes a drain plug configured to be telescopically received in the drain hole or central throughshaft defined in the insert sleeve associated with the drain hole. The drain plug has a first and an opposed second end as well as an outer body extending there between and a seal positioned proximate to the first end. The drain plug seal is moveable between a first contacted sealing position and a second open position. The drain plug includes a seal member that is attached to the outer body at a location proximate to the first end of the drain plug and extends outward therefrom. The drain plug also includes a connection member located on a second end of the body of the drain plug. The connection member is configured to releasably engage with the at least one lateral shoulder associated with either the drain opening or the drain plug movement mechanism. The drain plug device also includes means for biasing moving the drain plug device from the first contracted position to the second expanded position and means for maintaining the drain plug device in the first contracted position.

The drain plug movement mechanism movement can be configured as a biasing member that translates one portion of the drain plug relative to another portion such as that which is found in "pop up" mechanisms. It is also possible that the movement mechanism can be configured as a suitable lever arm in certain embodiments. It is also contemplated that the easy-removal drain plug device can be configured to accommodate other movement mechanisms as desired or required.

BRIEF DESCRIPTION OF THE DRAWINGS

In the various drawings views, like reference numerals are used for like elements.

DETAILED DESCRIPTION

The drain closure device as disclosed herein can be employed in various vessels to facilitate easy use and cleaning of various drains in tubs, sinks and the like.

Figure 8:
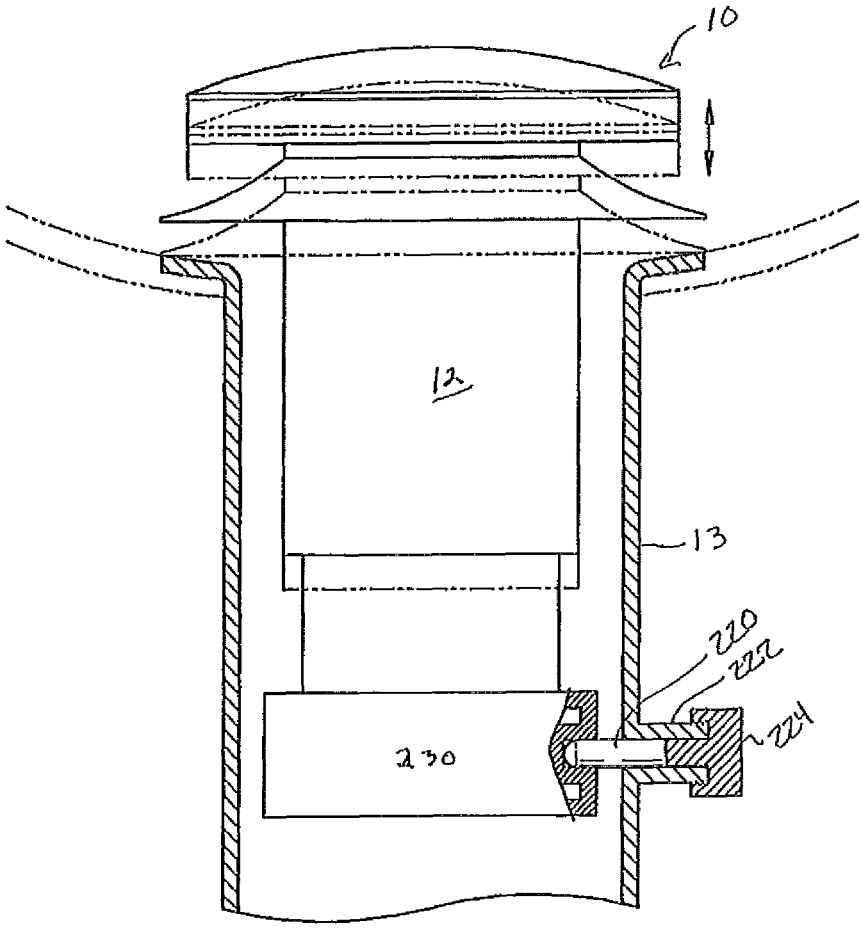
FIG. 8 is a side view of a third alternate embodiment the drain closure device as disclosed herein.

Throughout the various embodiments, the drain closure device 10 as disclosed herein broadly includes a drain plug 12 releasably insertable in an associated drain opening and configured to be telescopically moveable relative the associated drain opening. The drain plug 12 is configured with a suitable connection member configured to operably engage structure associated with the drain opening. The structure to which the connection member engages can be integral to the drain or can be configured on a suitable insert member including but not limited to a device such as an insert sleeve configured to be positioned in the drain opening. In embodiments such as those depicted in FIGS. 1, 5, 6 and 11, the device 10 includes a drain plug 12 insertable and attachable in the associated drain opening drain via an insert sleeve 14. It is also within the purview of this disclosure that the drain plug closure device 10 can be utilized by direct insertion in the drain opening and any associated drain opening as desired or required. It is also contemplated that the device 10 disclosed herein can be configured to engage with structure configured in the drain or associated drain pipes, one non-limiting example of such configuration is depicted in FIG. 8.

When an insert sleeve is employed, it can be configured to be telescopically received and connected to a drain hole D defined in a suitable vessel V. Non-limiting examples of insert sleeve configurations are depicted in the embodiments in FIGS. 1, 5, 6 and 1. The drain hole D communicates between the interior surface of vessel V and the exterior of the vessel. Suitable conduits can be associated with the drain hole D and can include a suitable conduits, pipes or the like.

The vessel V can be any suitable vessel configured to contain liquids such as water. In various embodiments, it is contemplated that the vessel V will be a suitable bathtub, sink or the like. The vessel will be configured to permit the user access to the interior surface thereof. Thus, devices such as sinks and tubs are particularly, but not exclusively, contemplated.

The drain closure device 10 can include suitable means for engaging the drain plug 14 in fixed relationship relative to the drain opening such that the drain plug 14 can translate between a drain-open and a drain-closed position. Non-limiting examples of such engagement means include at least one lateral shoulder that is configured to be connected to one of the drain plug 12, drain pipe P or insert sleeve 14.

Where an insert sleeve 14 is utilized, the sleeve 14 can be configured in any suitable manner to be engaged in the drain opening. Insert sleeve 14 can be configured to be either removeably or permanently connected to the region of the vessel V proximate to the drain hole D. In many instances, the connection will be of a permanent or semi-permanent nature. By the terms "permanent" and "semi-permanent" it is taken to mean that the sleeve will be mounted in such a fashion as to resist removal or ease-out during normal operation of the associated vessel V. In various embodiments depicted herein, the insert sleeve 14 is configured with an outwardly oriented threaded surface that will be described in greater detail subsequently. Other insert sleeve connection mechanisms are with in the purview of this disclosure.

It is within the purview of the present disclosure to utilize the drain closure device 10 in suitable tubs or sinks as desired. The device 10 can be used as a retrofit for drains that previously employed a lever-type closure device. One non-limiting example of such retrofit is set forth in the embodiment set forth in FIG. 8 and will be discussed in greater detail subsequently.

Figure 1:
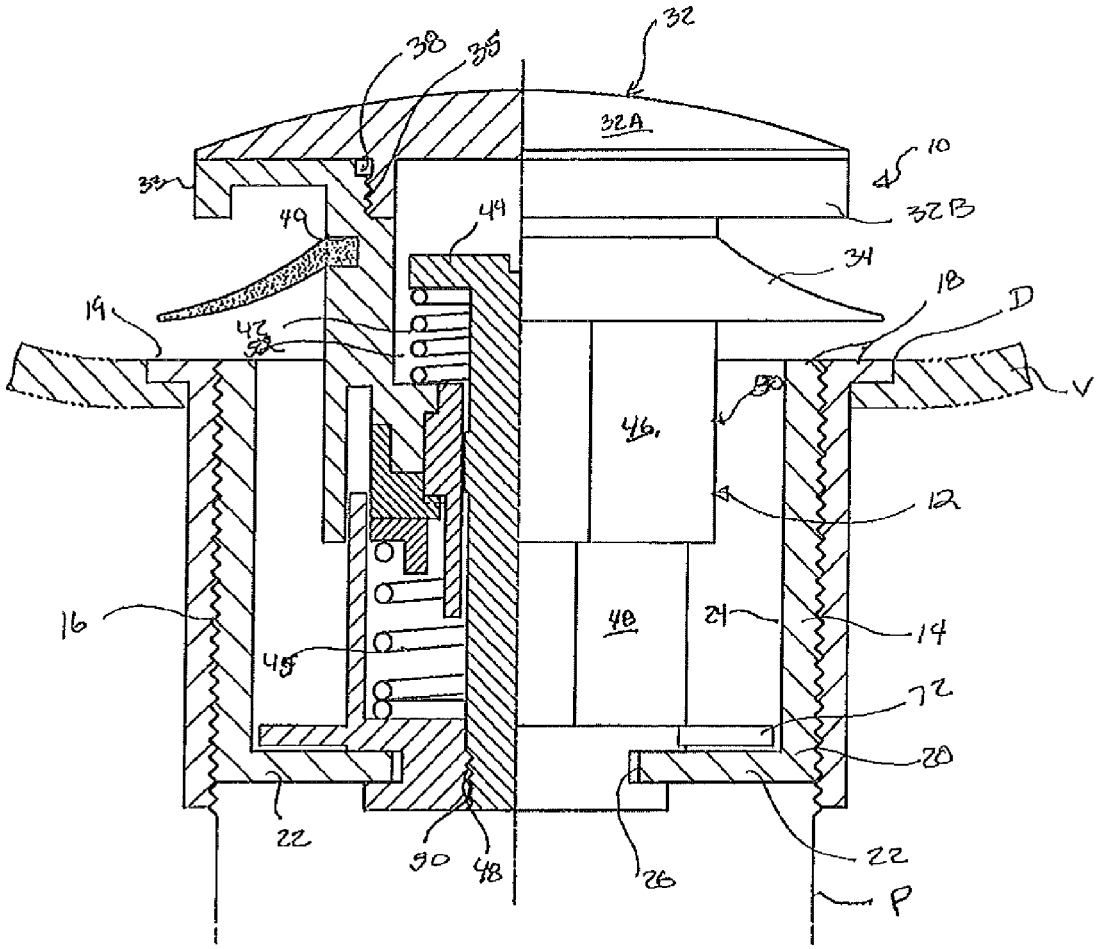
FIG. 1 is a side view with partial cutaway of a first embodiment of the drain closure device as described herein.
Figure 5:
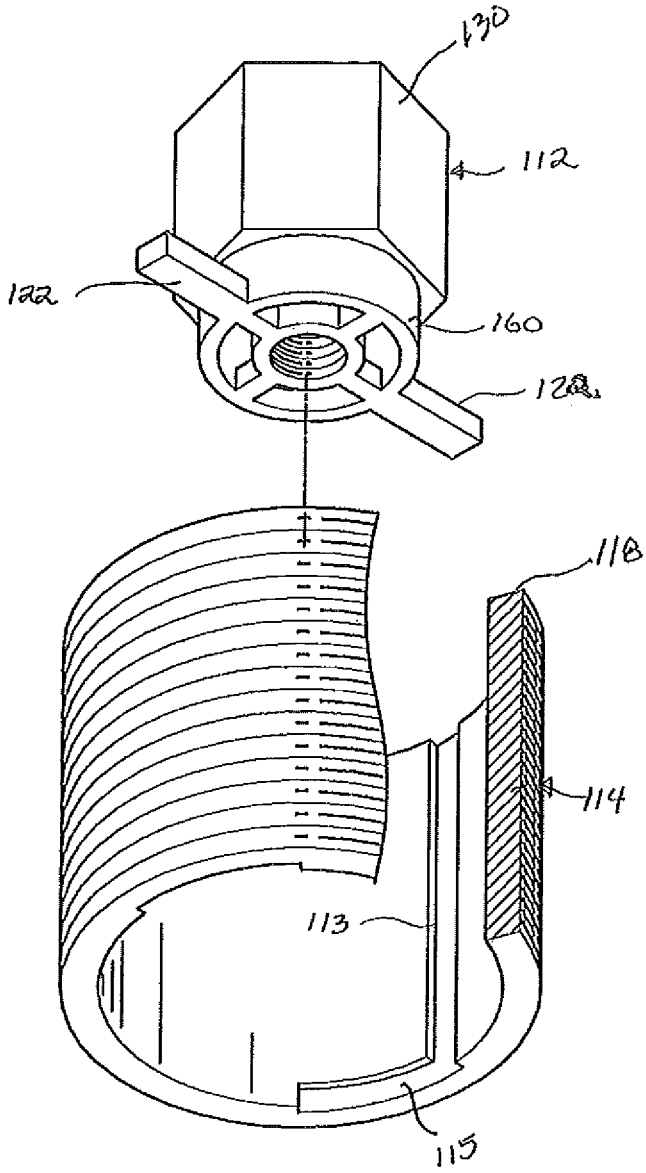
FIG. 5 is partial detail of an alternate embodiment of an engagement configuration between an insert sleeve and drain plug member as disclosed herein.

As depicted in various drawing figures, the insert sleeve 14 has an exterior facing surface 16 that is configured to be received on a corresponding surface defined in the vessel V. Where desired or required, the exterior facing surface 16 can be threaded in a manner that corresponds with a suitably threaded surface located on an interior face of the corresponding drain opening. In the embodiment as depicted in FIG. 1, the insert sleeve 14 has a first or upper surface 18 configured to be located proximate to the drain hole opening D. The first or upper surface 18 may be a blunt surface located flush to the surface of associated vessel V (as seen in FIG. 5). It is also considered within the purview of this disclosure that the upper surface 18 may include an upper lip or flange that projects outward from the uppermost region of the sleeve 14 to a location radially outward therefrom. The insert sleeve 14 may be received directly into a suitably configured drain hole D or into a suitable mating fitting such as mating fitting 19 as depicted in FIG. 1.

The insert sleeve 14 also includes a suitable lower region 20 that is distal to the upper region 18. In various embodiments, for example those depicted in FIGS. 1 and 6, the insert sleeve 14 has at least one lateral shoulder 22 located in the central throughshaft defined by insert sleeve 14. The lateral shoulder 22 projects inwardly from an interior surface 24 of the insert sleeve 14 to define a terminal end 26 located in the central throughshaft. In the various embodiments, the insert sleeve 14 can be configured with at least two opposed lateral shoulders 22. The number of lateral shoulders 22 projecting into the central throughshaft will be a number sufficient to support drain plug 12 during normal operation. The plurality of lateral shoulders 22 can be positioned in spaced relationship around the circumference of the insert sleeve 14.

It is also considered to be within the purview of this disclosure to configure the fitting 19 or associated drain pipe P with suitable lateral shoulder(s) 22 in the absence of an insert sleeve 14.

The insert sleeve 14 defining a central throughshaft will have sufficient configuration to permit the suitably rapid egress of fluid from the associated tub or sink. Typically, such throughshafts are circular in diameter. However, the present disclosure is not limited solely to such configurations.

It is also within the purview of the present disclosure that device can be configured to accommodate lateral shoulder(s) positioned on and projecting from the associated drain plug member. In the embodiment depicted in FIG. 5, the insert sleeve 114 can be configured with at least one slot 113 defined on the inner surface of the insert. The slot is configured to engage the terminal end of a suitable lateral arm 120. Slot 113 terminates in a lateral groove 115 adapted to receive that terminal end of the associated lateral shoulder 122 and direct it in a circumferential direction of travel. In this embodiment at least one lateral arm 120 is configured to project from the lower region of the drain plug proximate to connector 160 to releasably engage suitably configured surfaces on either the associated drain pipe or the insert sleeve.

An alternate configuration of the engagement means is depicted in FIG. 8. In such embodiments, the engagement means can be configured as a lateral shoulder 220 that is associated with the drain pipe 13. Lateral shoulder 220 can be configured in the associated pipe and/or pipe fitting as desired or required. Alternately lateral shoulder 220 can be inserted and/or attached to drain pipe 13 by any suitable means. One non-limiting example illustrated in the embodiment in FIG. 8 provides lateral shoulder 220 inserted through a suitable through slot 222 defined in the pipe 13 and held in place by any suitable attachment device. In the particular embodiment depicted, the lateral shoulder 220 is held in place with a suitable waterproof plug 224. The through slot 222 defined in the pipe of fitting member for the purpose. Alternately, the through slot can be a channel previously utilized for a different purpose and retrofitted to accommodate the lateral shoulder 220 such as a through slot configured to accommodate a pre-existing closure lever mechanism.

The drain closure device 10 includes a suitable drain plug 12, 112 configured to be telescopically received in the drain opening D and/or the central through shaft as defined in the insert sleeve 14, 114. In addition to the engagement mechanism, the drain plug 12, 112 includes a central body 30, 130 having a first or upper end and an opposed second or lower end as determined when the drain plug 12, 112 is in position in the associated drain opening D.

The drain plug 12 also includes a head 32 mounted to the first or upper end of the outer body 30 as well as a suitable seal 34 associated with the head and outer body in a suitably sealing manner. The head 32 can be mounted on the outer body 30 by any suitable means. Where desired or required, the head 32 can be integrally formed with the outer body 30. In various embodiments, seal 34 extends laterally outward from the outer body 30, 130 to a position sufficient to contact the associated vessel surface as desired or required.

Figure 11:
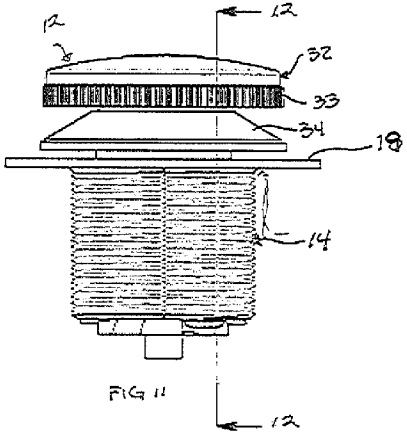
FIG. 11 is a side view of a fifth alternate embodiment the drain closure device as disclosed herein.
Figure 14:
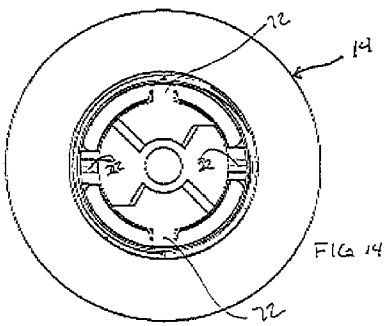
FIG. 14 is a top view an embodiment of an insert sleeve as disclosed herein and depicted in FIG. 11.

Head 32 can be configured to include one or more elements. In the embodiment depicted in FIG. 1, the head 32 is composed of a suitable cap 32A and a shoulder member 32B. Shoulder member 32B can have an outer circumferential surface 33 that can be textured to facilitate gripping as desired or required. One non-limiting example of texturing is illustrated in FIG. 11 in which the outer circumferential surface 33 is configured with a plurality of ridges or grooves.

In the embodiment depicted in FIG. 1, the head 32 includes a cap 32A having a threaded region 35 configured to contact a mating threading surface defined in the upper region of the outer body 30 as well as a shoulder member 32B contiguously joined to the upper portion of the outer body 30 to permit access to the inner mechanism of the associated drain plug 12 The connection between cap 32A and body 30 can also include a suitable seal such as O ring 38 to insure water tight connection as desired or required. The present disclosure contemplates other types of engagement mechanisms as required.

The configuration of cap 32A can vary depending upon the specific end use application. Non-limiting examples of possible configurations for cap 32A are illustrated in the various drawing figures. In the embodiment depicted in FIGS. 1 and 9, the cap 32A has a concave outer surface. In the embodiment depicted in FIG. 6, cap 32A has a knob 37. In the embodiment depicted in FIG. 11, cap 32A has suitable indicia positioned on the upper surface.

Figure 2:
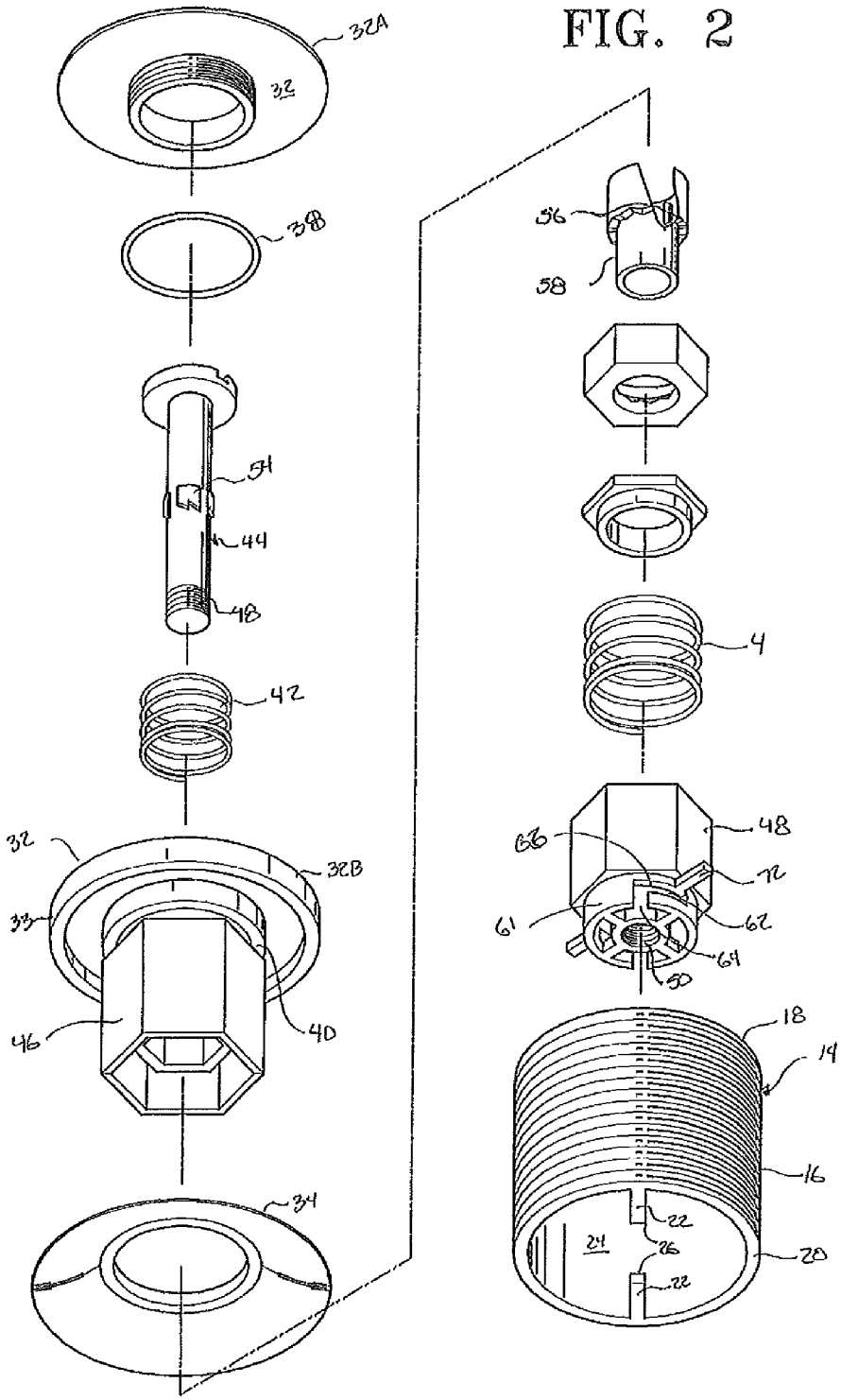
FIG. 2 is an exploded view of the embodiment of the drain plug closure device of FIG. 1.

The seal 34 can be attached to the outer body 30, 130 by any suitable mechanism. It is contemplated that the seal will composed of a suitably flexible sealing material that can provide a water tight compression seal. The connection as depicted in FIGS. 1 and 2 can be one of mechanical and friction fit into a suitable detent such as detent 40 defined in the outer body 30 at a location proximate to the first or upper region of the drain plug 12 in the general proximity to cap 30.

The drain plug 12 as defined herein is a device that can be moveable between a first sealed position and a second drain position. The sealed position is illustrated variously in FIGS. 7 and 10 in which the outermost region of seal 34 engages a corresponding surface on the vessel V and/or insert sleeve 14. The unsealed position is illustrated in 6 and 9 in which the seal is disposed in spaced relation to the respective surface. In various embodiments depicted herein, the drain plug can be configured as a "pop up" mechanism. The "pop up" mechanism of the drain plug can be configured as desired. It is to be understood that the various configurations discussed and illustrated herein are non-limiting examples.

In the various "pop up" type devices the head 32 and associated seal 34 move between the first sealed position in which the seal 34 sealingly engages the surface of the vessel V and/or insert sleeve 14 in a manner that prevents the egress of fluid from the associated vessel through the drain mechanism and a second position that permits fluid to exit through the drain. The second or drain position is one in which the seal member 34 is removed from contact with the vessel and/or the associated insert sleeve in a fashion that permits and facilitates the removal of water or other liquid from the vessel through the drain. In the embodiment set forth in FIG. 1, the "pop-up" device presented therein is shown in its second or drain position.

Figure 4A:
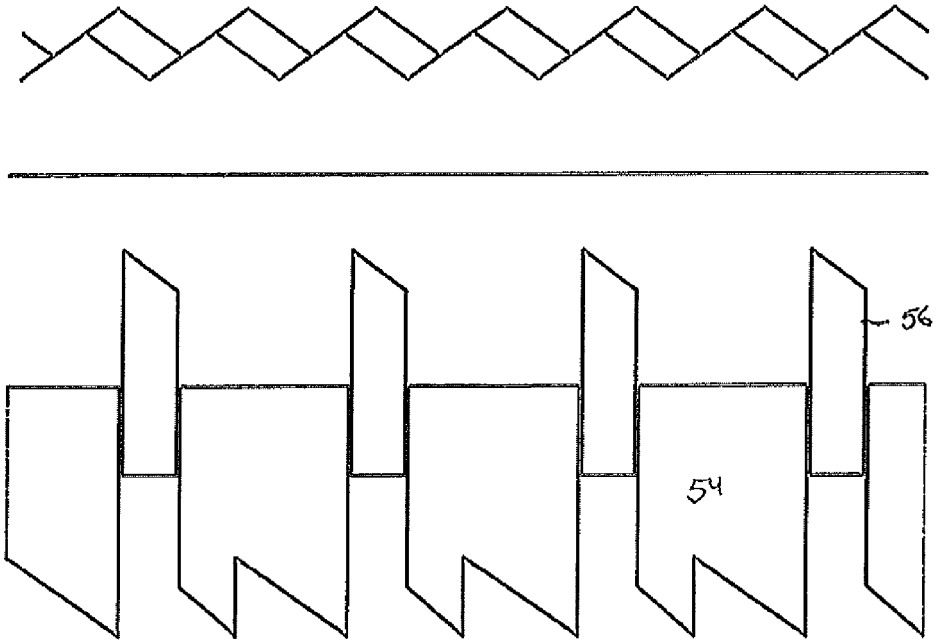
FIG. 4A-D are detail views of engagement member surfaces of the embodiment depicted in FIG. 1 in various stages of engagement.
Figure 4B:
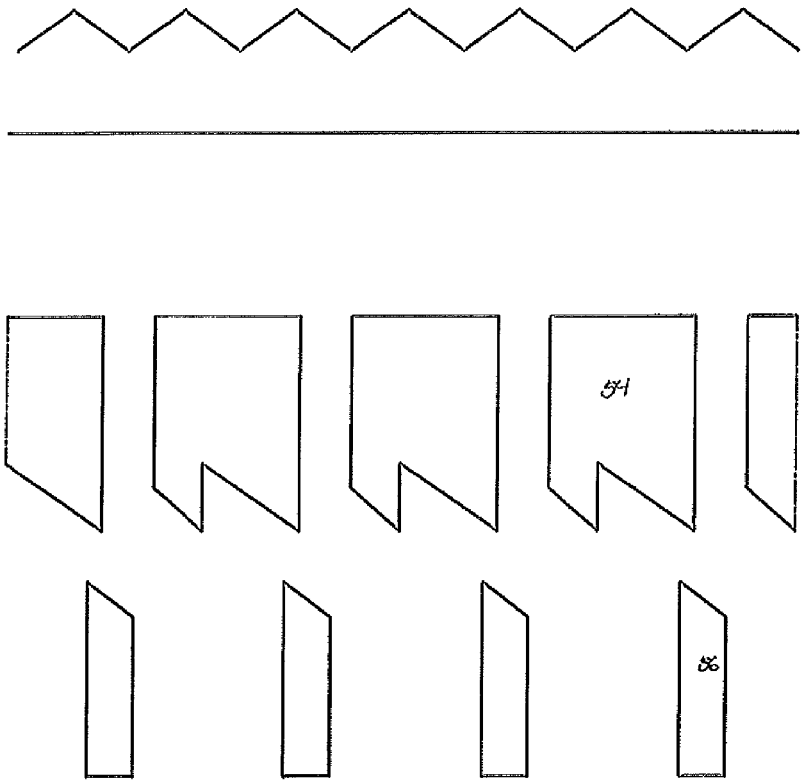
Figure 4C:
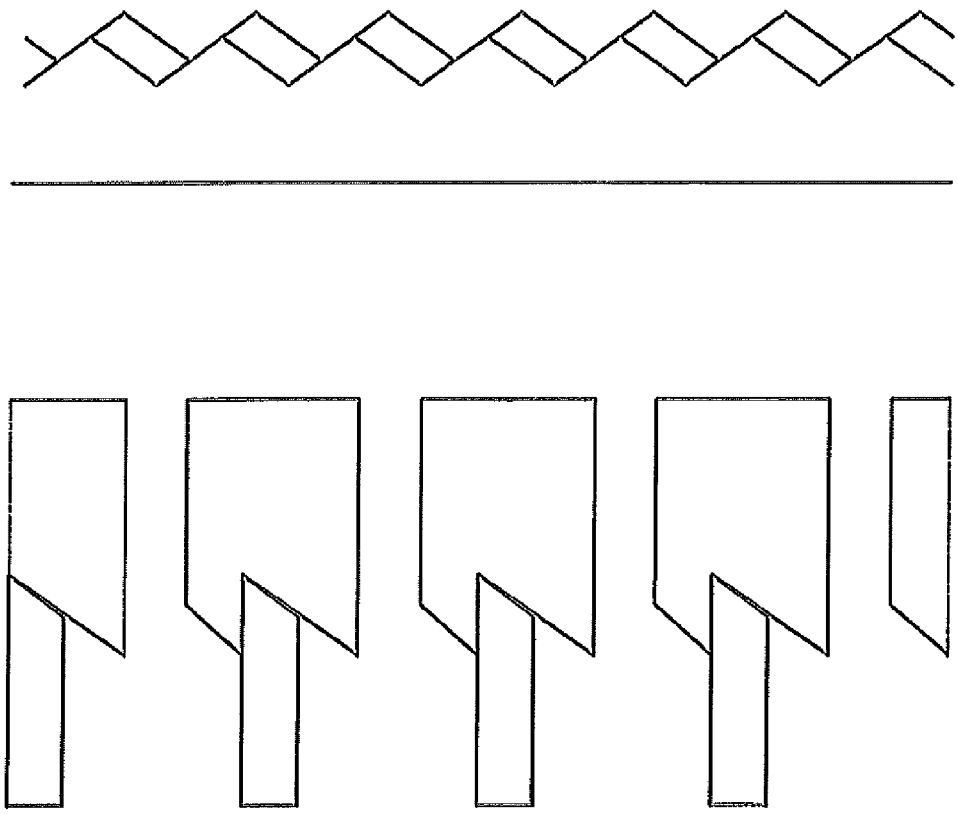
Figure 4D:
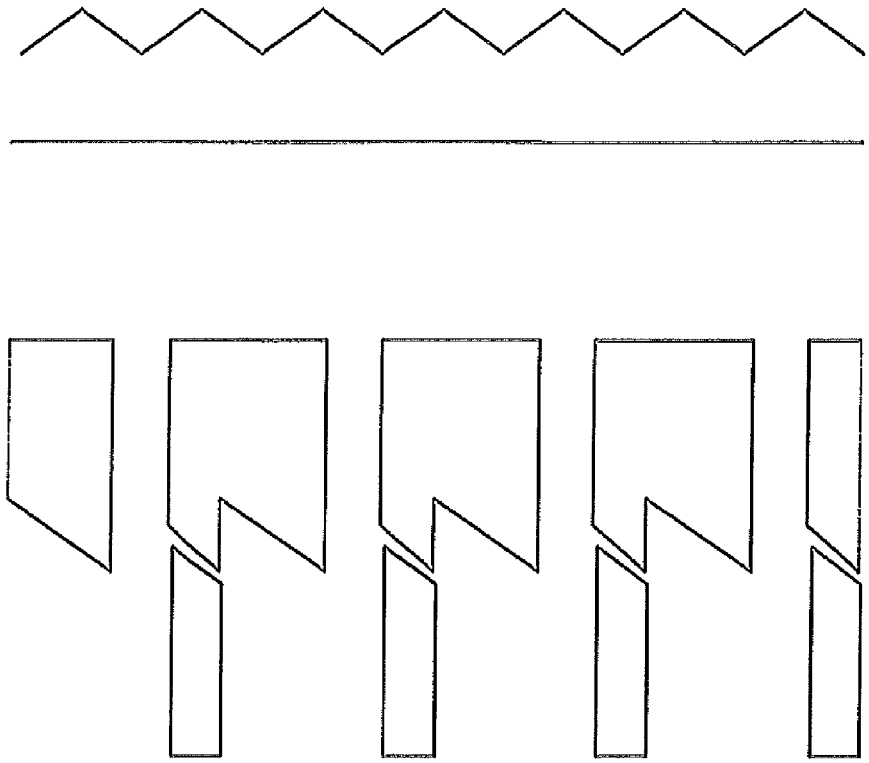

Various pop-up type devices can be employed in the device in the present invention. The non-limiting example depicted in FIGS. 1 and 2 utilizes a mechanism that includes opposed biasing means 40, 42 mounted around a central shaft such as bolt 44. The outer body 30 is composed of two members 46 and 48 configured to be telescopically received relative to one another. The central shaft member such as bolt 44 extends radially through the center of the two members 46, 48 if can be outer body 30. Bolt 44 connected to the lower portion 48 of the outer body 30 such that the bolt 44 and lower portion 48 move contemporaneously with one another. The attachment of bolt 44 to lower portion 48 of outer body 30 can be accomplished by any suitable device. In the embodiment depicted in the FIGS. 1 and 2 the bolt 44 includes a suitable threaded lowermost region 48 configured to be threadingly received in a mating threaded surface 50 defined on the lower body member 48. The lower body member 48 includes an inner central region into which a suitable biasing member such as spring 45 can be inserted The upper portion 46 of the outer body includes a suitable inner cavity 52 that communicates with the upper portion of the outer body. The cavity 52 is configured to receive the upper portion of the bolt 44 as well as a suitable biasing means such as spring 42. The upper portion 46 of the outer body 30 is configured such that downward pressure on the head 32 associated with the outer body 30 compresses the upper portion 46 of the outer body downward over the lower portion 48 against the biasing force exerted by the lower biasing means such as spring 45. The downward pressure permits the biasing means 42 to engage against the upper member of the bolt 44 to move the member relative to stop 54 configured on bolt 44 and suitable mating members 56 contained in ferrule 58 to lock the upper body member 46 and lower body member 48 in the compressed configuration and maintain the drain plug member 12 in the compressed or sealed until an additional counter pressure is exerted on the drain plug 12 to reengage the lower biasing means. Non-limiting examples of suitable mating patterns for members 56 and 58 throughout the compression and decompression sequence are illustrated in FIGS. 4A to 4D with the orientation illustrated in FIG. 4A representing the locked compressed position.

Figure 6:
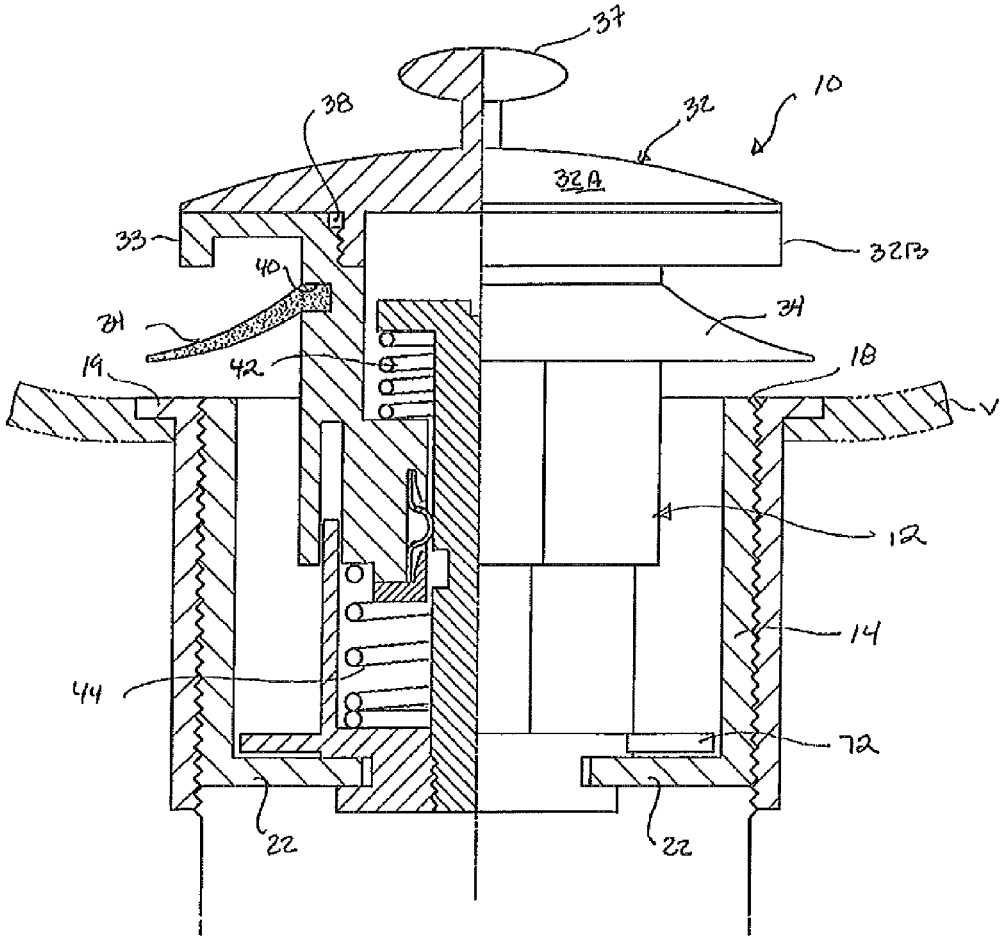
FIG. 6 a side view of a drain plug device according to a second alternate embodiment of the drain closure device as disclosed herein.
Figure 7:
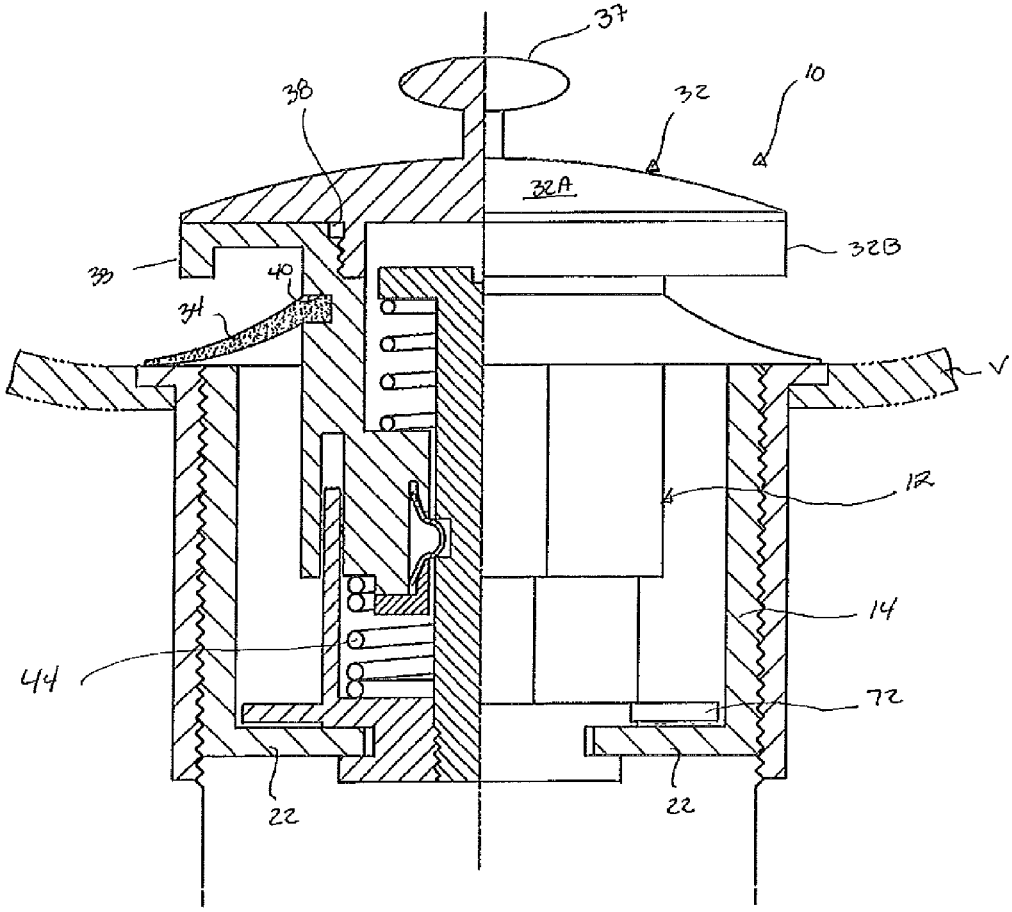
FIG. 7 is a side view of the device of FIG. 6 in the sealed position.
Figure 9:
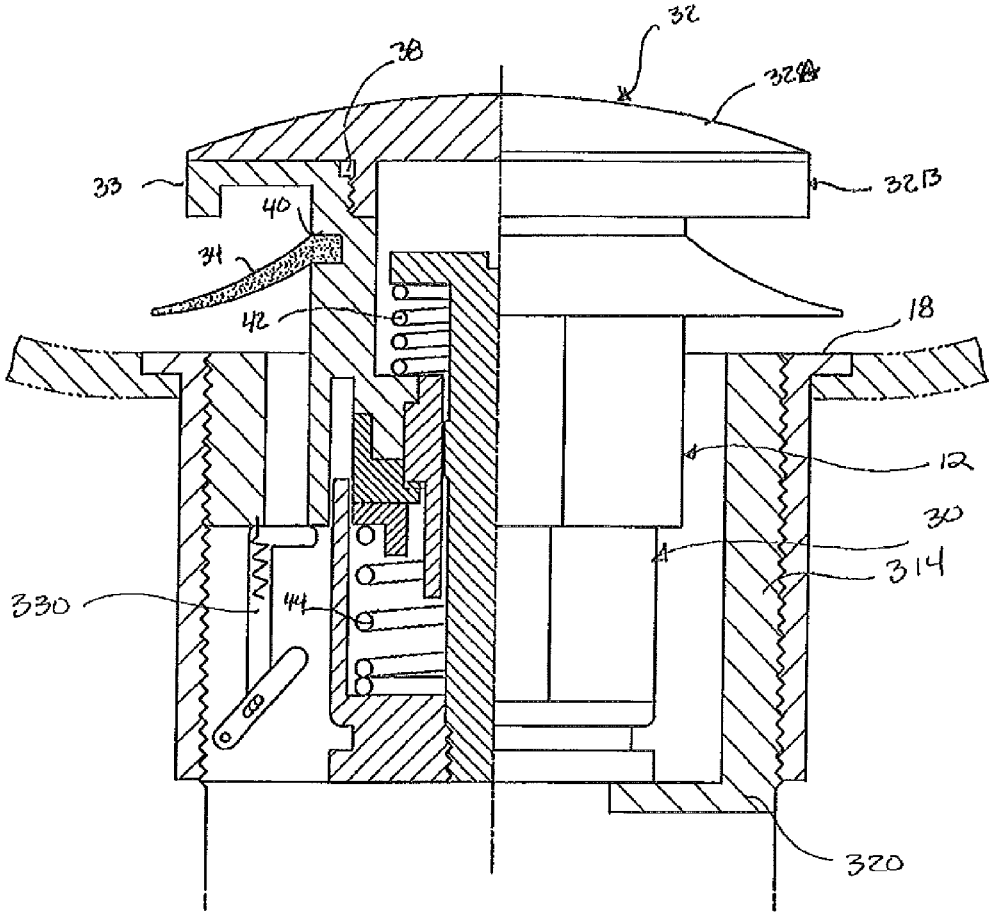
FIG. 9 is a side view of a fourth alternate embodiment of the drain closure device as disclosed herein presented in the open position.
Figure 10:
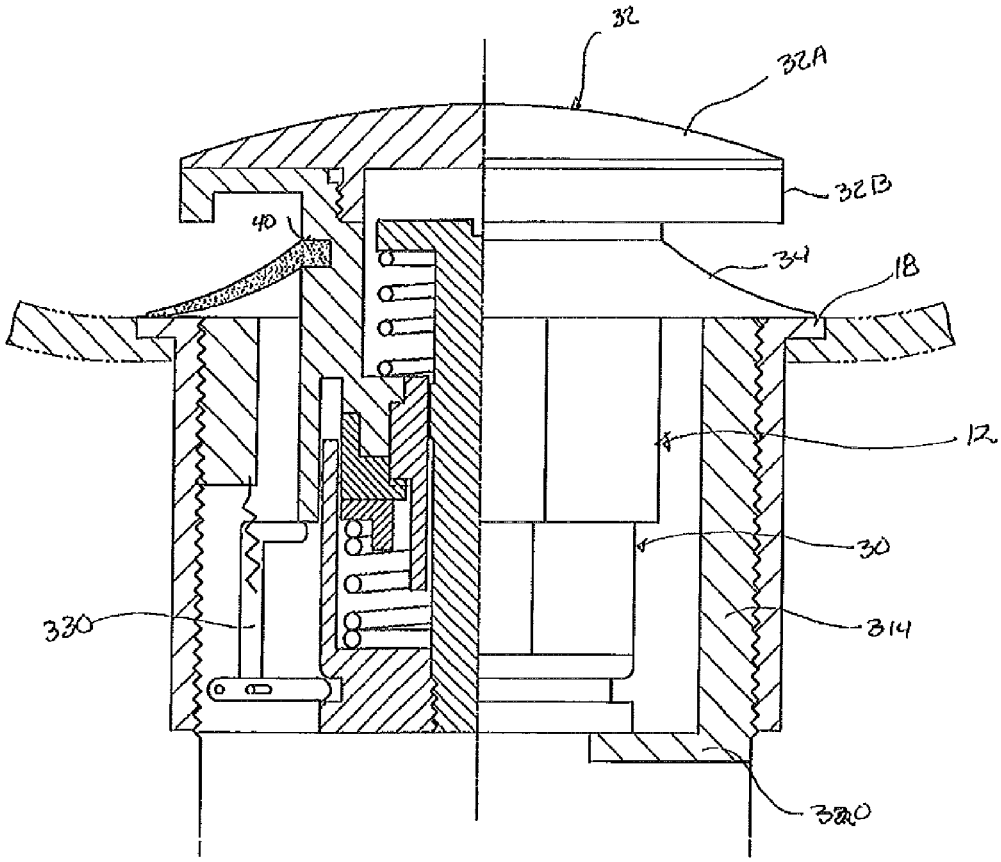
FIG. 10 is a side view of the device of FIG. 9 in the presented in the closed position.
Figure 13:
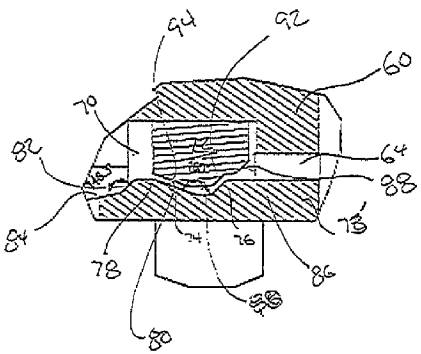
FIG. 13 is a detail view taken in FIG. 12.
Figure 12:
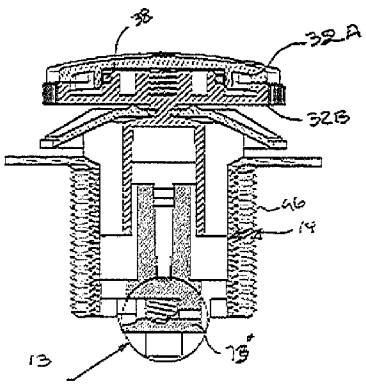
FIG. 12 is a cross sectional view taken through the 12-12 line in FIG. 11.
Figure 15:
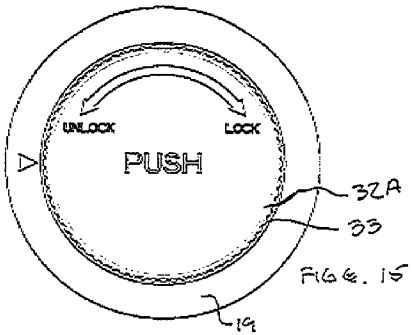
FIG. 15 is a top view of FIG. 11.

Various alternate locking mechanisms are presented in various drawing figures such as FIGS. 6 and 7, decompressed and compressed respectively and FIGS. 9 and 10, decompressed and compressed respectively. Additional non-limiting examples of suitable drain closure mechanisms that could be employed with the device of the present invention include those found in U.S. Pat. No. 4,720,877; U.S. Pat. No. 6,363,544, the specifications of which is incorporated herein by reference. It is to be understood that other suitable biased or pop-up drain mechanisms can be employed successfully in the invention herein.

The drain plug 12 includes connection member 60 configured to axially position the associated drain plug relative to the drain hole or opening D and/or the insert sleeve 14. The connection member 60 and drain/insert sleeve are each configured with at least one of a lateral shoulder member 22, 122 and/or a lateral slot member. The connection member 60 is positioned proximate to the lower region of the outer body 30 and is configured to engage the associated drain structure to maintain the drain plug in position during routine operation as well as to permit disengagement and removal of the drain plug 12 when desired or required for clearing, cleaning and the like.

In the embodiment depicted in the drawing in FIGS. 1 and 2, the connection member 60 is configured with an outer side face 61 and at least one lateral slot 62 positioned therein. Lateral slot 62 of connection member 60 is configured to engage associated drain structure such as lateral shoulder 22 located on drain insert 14 so as to maintain the drain plug 12 in position during routine operation and also to permit disengagement and removal of drain plug 12 when desired such as for clearing, cleaning and the like. The connection member 60 of drain plug 12 can have more than one additional lateral slot as desired or required. In the embodiment depicted in FIGS. 1 and 2, the connection member has two opposed lateral slots 62 positioned to engage associated lateral shoulders 22.

Figure 3A:
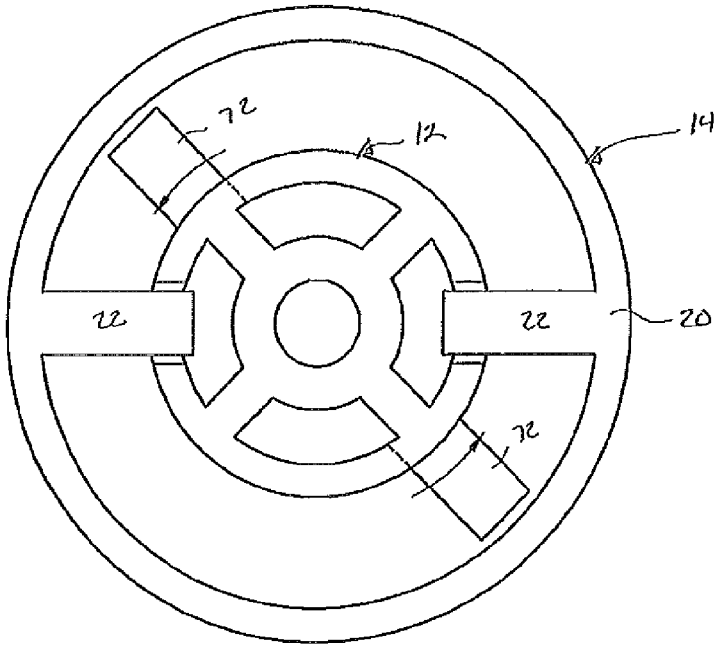
FIGS. 3A and 3B are bottom plan views of the device of FIG. 1 in the engaged and non-engaged orientation, respectively.
Figure 3B:
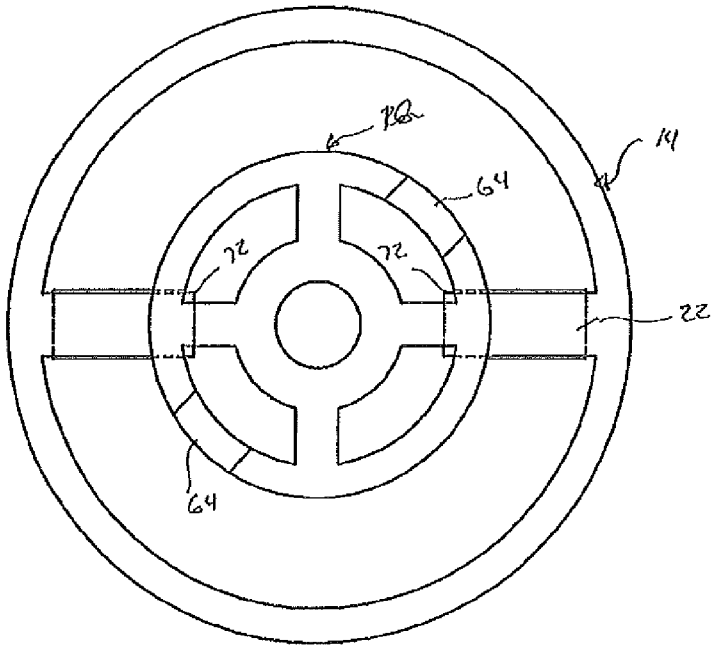

The lateral slot(s) such as lateral slot 62 configured in connection member 60 can be suitably configured to engage the terminal end 26 of the associated lateral shoulder 22. The lateral slot 62 of the connection member will have a width greater than the thickness of the lateral shoulder 22. The lateral slot 62 located in connection member 60 also has sufficient depth to maintain the lateral shoulder 14 in secure engagement therewith. In the embodiment depicted in FIGS. 1 and 2, the connection member 60 further includes an entry slot 64 in angular communication with the lateral slot 62. The entry slot 64 is configured with a width greater than the width the lateral shoulder 22. Typically, the entry slot 64 extends in a downward fashion relative to the drain plug body 30 such that the drain plug member 12 can be lowered into engagement with the associated lateral shoulder 22 lateral shoulder 14. Downward motion of the drain plug member 12 relative to the insert 14 terminates when the lateral shoulder 22 engages the upper surface 66 of lateral slot 62. At this point, the drain plug member 12 can be rotated axially as depicted in FIGS. 3A and 3B until the lateral slot 62 encounters the terminal wall 68 located distal to the entry slot 64. In this way, the lower most portion of the drain plug 12 is maintained in engagement with associated drain.

In order to remove the drain plug 12 from engagement in the drain, the drain plug 12 is rotated in the opposite direction until contact is made with the entry slot wall 70. After contact is made, the drain plug mechanism 12 can be lifted from engagement with the insert sleeve 14 or suitable lateral shoulder elements configured on the associated drain member.

If desired or required, the drain plug 12 can also include a suitable outwardly extending sweeper arm 72 that is configured to extend outward from the outer body to a terminal position proximate to the inner surface 24 of the insert sleeve. The sweeper arm 72 is contiguously attached to the drain plug 12 at a suitable location. In various embodiments, the sweeper arm 72 is position proximate to the lower end of the drain plug 12. In the embodiment depicted in FIGS. 1 and 2, the sweeper arm 72 is contiguously attached and projects outward from the connection member 60 and is positioned at a location proximate to the terminal end of the lateral slot 64 in a region proximate to the junction of the connection member 60 and the lower member 42. However, other locations are considered within the purview of this disclosure.

The sweeper arm 72 also will have a configuration suitable to snag and contain any hair or other debris that may pass through the drain opening while permitting and facilitating water flow through the drain opening. In the embodiment depicted in FIGS. 1 and 2, the sweeper arm 72 projected perpendicularly outward from the connection member 60 to a distance configured to closely span the space defined between the side surface 61 of the connection member and the inner face of the associated insert sleeve 14, drain pipe or the like.

During insertion, the drain plug 12 is brought into engagement with the lateral arms at lateral opening 64 and rotated in the direction of the arrows shown in FIG. 3A. The sweeper arm 72 can be positioned relative to the lateral slot 62 such that the sweeper arm 72 is in essentially overlying relationship to the lateral arms 22 when the drain plug 12 is oriented in the use position as illustrated in FIG. 3B. When removal of the drain plug 14 is required, the drain plug 12 can be rotated in the direction opposed to the arrows in FIG. 3A, and withdrawn from the drain opening.

When the drain plug device as disclosed herein is removed from engagement with the insert member 14, the sweeper arm 72 sweeps proximate to the inner surface 24 of the insert device snagging hair or any other material to facilitate its easy removal from engagement in the insert sleeve 14. Upon removal of the drain plug 12, hair or other material can be removed from contact with the sweeper arm 72 by any suitable means prior to reinserting the drain plug 12 in the closure device 10.

One alternate attachment embodiment is depicted in FIG. 5 in which lateral shoulder 122 projects from the connection member 160 configured on the lower end of drain plug 112. The lateral shoulder(s) 122 engage a suitable quick slot 113 configured in either the insert (as illustrated) or in the associated drain. The lateral shoulder 122 sweeps the sides of the associated insert sleeve 114, bringing any hair or entrained debris out of the drain where it can be removed.

Another alternate attachment embodiment is depicted in FIG. 8. The drain closure device 10 can be utilized in existing drains previously configured with lever closure mechanisms. The lever closure mechanism (not shown) can be removed from the through slot 222 configured in the drain and replaced with a suitable lateral shoulder 220 and seal 224. The lateral shoulder 220 is configured to engage a suitable lateral slot in the connection member 230 at associated with the drain plug 12. The drain plug 12 can be configured as a suitable "pop up" mechanism. Seated and unseated positions are depicted in the drawing figure.

FIGS. 9 and 10 depict an alternate engagement configuration. Insert sleeve 314 can be configured with lateral arm(s) 320 that project into the center of the shaft defined by the insert sleeve 314. The lateral arms project a sufficient distance to engage and support the lowermost region of the inserted drain plug 12. In the embodiment depicted in FIGS. 9 and 10, a "pop up" type drain plug 12 is employed. The insert sleeve 314 can be configured with a suitable latch mechanism to assist in maintaining the drain plug 12 in secure engaged relationship such as spring loaded latch mechanism shown in the drain position (FIG. 9) and the latch position (FIG. 10).

The drain plug 12 configured with the pop up mechanism can be maintained u position utilizing the lateral slot 62 as previously configured and depicted in many applications. In certain embodiments, it is desirable to provide various locking mechanisms configured to maintain the drain plug 12 in fixed engagement with a suitably configured associated insert sleeve 14. One non-limiting example of a suitable locking mechanism illustrated in the embodiment depicted in FIGS. 11 through 14.

In the embodiment set forth in that embodiment, the lateral slot 64 of connection member 60 is configured with an entrance region 70 defined by a lower arm 73 oriented essentially perpendicular to the lowermost region of the drain plug 12. The interior-facing surface of the of the lower arm has a least one detent member 74 bounded on one end by a locking wall or stop 76 on the interior region and on the opposite end by a shoulder 78. The locking wall or stop 76 is a wall member configured to contact a mating locking surface of lateral arm. In various embodiments, the wall defining locking wall or stop 76 is disposed at a first incline relative to arm 73. The locking wall or stop 76 is configured with an incline having a slope oriented at an angle relative to vertical sufficient to provide a locking arrangement between the lateral slot and associated shoulder. In certain embodiments, it is contemplated that the incline will have a slope of approximately 45 degrees±15 degrees.

Detent member 74 is defined by an opposed angularly inclined opposed wall 80 that extends between the lowest portion of the detent member 74 and the shoulder 78. The angularly inclined opposed wall 80 has an incline that it less that the incline of locking wall or stop 76. In various embodiments, the incline of the angularly inclined or opposed wall 80 can have a slope suitable such that the torque required to disengage the associated lateral shoulder is less than that required to achieve initial engagement. In certain embodiments, the inclined opposed wall 80 can have an incline of 15 degrees±10 degrees.

The leading surface 82 of entrance region 70 has a slope with a value between that of the forward wall 60 and the locking wall or stop 76. In certain specific embodiments, the slope of leading surface 82 will have a value that is between the incline value for the locking wall or stop 76 and the incline value for the inclined opposed wall 80. In certain embodiments, the incline value for leading surface 82 will be approximately 45 degrees±15 degrees.

The entrance region 70 can be configured with a forward guide region 84 configured to direct and orient the associated lateral arm 22 into engagement with the leading surface 82.

The insert sleeve 14 can be configured with one or more lateral arms 22 configured with a surface 86 configured to engage the inwardly facing region of the arm 73 in mating engagement. In the embodiment illustrated in FIGS. 11 through 14, the lateral arm 22 has a sloping or forward or leading surface 88 configured to guide the drain plug 12 relative the lateral shoulder 22.

When the leading surface 88 engages the forward edge of the associated lateral shoulder 22, rotational movement of the associated drain plug 12 relative to the insert sleeve 14 urges the leading surface 82 of the lower arm 73 past the lowest portion 90 of the lateral arm 22. The lateral shoulder 22 is past the leading edge, the lower surface of lateral shoulder 22 comes into the engagement with the detent defined by opposed faces 74, 76.

The lower face of the lateral shoulder 22 can be configured with sloping surfaces that correspond to the surfaces defined in the lower arm 73. Forward surface 92 has a first slope roughly corresponding to the slope of surface 76. Rearward surface 94 has a second slope that corresponds to the slope of surface 74 and is less than the first slope of surface 92.

The associated insert sleeve 14 as depicted has a threaded outer surface 96. The sloped surfaces 76, 92 are positioned so as to correspond to the insert or tightening direction of the outer threaded surface 96 of insert sleeve 14. The second slopes are located on the directionally opposed surfaces. The positioning of the respective sloped surfaces will result in general tightening of the device 10 with insertion of the drain plug 12; while the lesser slope of the opposed surfaces 74, 94 will permit rotational movement of the drain plug 12 relative to the insert sleeve without associated movement of the insert sleeve 14. In this manner locking torque is greater that unlocking torque. Thus the torque need to remove the drain plug 14 does not undo the torque necessary to position the drain plug 12 and/or the insert sleeve 14.

In the embodiment illustrated, the drain plug 14 has a pair of sweeper arms 72 in opposed relationship to one another. It is contemplated that sweeper arms 72 can be positioned above the detent defined in the lateral arm 73. Where desired or required, the drain plug can be configured with additional sweeper arms 72. In the embodiment depicted in FIGS. 11 though 15, the drain plug 12 is configured with at least two sweeper arms 72 oriented in opposed relationship midway between the lateral arms 73.

The cap 32A in the embodiment depicted in FIGS. 11 through 15 can have any suitable configuration and indicia. In the embodiment depicted, the cap bears suitable "lock" and "unlock" indicia. Where desired or required, the upper flange of insert sleeve 14 can have suitable arrows or notations to assist the user in orienting the use or removal position.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A drain closure device for a vessel having an interior surface and a drain hole defined in the interior surface, the drain hole configured to communicate with a drain pipe, the drain closure device comprising:

a drain plug configured to be telescopically received in the drain hole defined in the vessel, the drain plug moveable relative to the drain hole between a first sealed position and a second unsealed position, the drain plug including:

an elongate drain plug body having a first end and an opposed second end;

a seal member attached to an outer surface of the drain plug body at a location proximate to the first end and extending outward therefrom, the seal member configured to sealingly engage an associated surface of the vessel located proximate to the drain hole when the drain plug is oriented in the first sealed position; and a connection member located proximate to the second end of the drain plug body, the connection member configured to be releasably engage at least one lateral shoulder associated with the drain hole when the drain plug is in either the first sealed position or the second unsealed position, the lateral shoulder having a thickness and a width; and at least one movement mechanism configured on the drain plug relative to a drain opening, the movement mechanism to trigger translational movement of at least a portion of the drain plug relative to the drain opening, the movement mechanism to act on the drain plug such that the seal member is moved from the first sealed position to the second unsealed position.

2. The drain closure device of claim 1, wherein the connection member of the drain plug has at least one lateral slot configured to engage the terminal end of the lateral shoulder, the lateral slot having a width greater than the thickness of the lateral shoulder.

3. The drain closure device of claim 2, wherein the connection member further defines an entry slot in angular communication with the lateral slot, the entry slot having a width greater than the width of the lateral shoulder.

4. The drain closure device of claim 3, wherein the connection member further defines a terminal wall located in the lateral slot at a location distal to the entry slot.

5. The drain closure device of claim 3, wherein the drain plug further comprises at least projecting shoulder connected to the drain plug body at a location proximate to the second end, the drain plug shoulder member extending outward from the projecting shoulder.

6. The drain closure device of claim 3, wherein the drain plug body has an upper member and a lower member telescopically received within the upper member, wherein the connection member is formed on the body of the lower member.

7. The drain closure device of claim 6, wherein the upper and lower member define an interior cavity and wherein the drain plug further comprises at least one biasing member, the biasing member contained in the cavity such that the upper member is moveable relative to the lower member in response to biasing action.

8. The drain closure device of claim 6, wherein the drain plug is configured as a pop-up mechanism.

9. The drain closure device of claim 6, further comprising an insert sleeve, the insert sleeve configured to be telescopically inserted into the drain opening, the insert sleeve comprising a body having a upper surface, an opposed lower surface and a central throughshaft extending from the upper surface to the lower surface, wherein the upper surface is configured to be positioned proximate to the interior surface of the vessel, and wherein at least one lateral shoulder is connected to the insert sleeve at a location proximate to the lower surface and extends inward therefrom to a terminal end located in the central throughshaft.

10. The drain closure device of claim 9, wherein the lateral slot of the connection member engages to the lateral shoulder defined on the insert sleeve when the drain plug is an operative position.

11. The drain closure device of claim 9, wherein the lateral slot comprises at least one lever arm in realeasable contact with the connection member of the drain plug mechanism, the movement mechanism having at least one element projecting out side the drain pipe and actuatable therefrom.

12. The drain closure device of claim 11, wherein the movement mechanism includes the lateral shoulder positioned to engage the lateral slot on the connection member.

13. The drain closure device of claim 2 wherein the lateral slot is configured with at least one sloping first face an and opposed sloping second face opposed to the first face, wherein the first face of defined in the lateral slot engages a mating surface defined on the lateral shoulder such that torque exerted on the lateral shoulder and associated insert sleeve upon insertion of the associated drain plug exceeds torque exerted on the lateral arm and associated insert sleeve during removal of the drain plug from connection with the insert sleeve.

14. The drain closure device of claim 1 further comprises at least one sweeper arm defined on the closure member and projecting outward therefrom.

15. The drain closure device of claim 14 wherein the at least one sweeper arm is positioned proximate to the lateral slot.

16. A drain closure device for a vessel having an interior surface and a drain hole defined in the interior surface, the drain closure mechanism comprising:

a drain plug configured to be telescopically received in the drain hole defined in the vessel, the drain plug moveable relative to the drain hole between a first sealed position and a second unsealed position, the drain plug including:

an elongate drain plug body having a first end and an opposed second end;

a seal member attached to an outer surface of the drain plug body at a location proximate to the first end and extending outward therefrom, the seal configured to sealingly engage an associated surface of the vessel located proximate to the drain hole when the drain plug is oriented in the first sealed position; and a connection member located proximate to the second end of the drain plug body, the connection member configured to be releasably engage at least one lateral shoulder associated with the drain hole when the drain plug is in either the first sealed position or the second unsealed position, the lateral shoulder having a thickness and a width, wherein the connection member of the drain plug has at least one lateral slot configured to engage the terminal end of the lateral shoulder, the lateral slot having a width greater than the thickness of the lateral shoulder, and wherein the connection member further defines an entry slot in angular communication with the lateral slot, the entry slot having a width greater than the width of the lateral shoulder; and at least one movement mechanism configured on the drain plug relative to a drain opening, the movement mechanism to trigger translational movement of at least a portion of the drain plug relative to the drain opening, the movement mechanism to act on the drain plug such that the seal member is moved from the first sealed position to the second unsealed position.

17. The drain closure device of claim 16 further comprising:

an insert sleeve configured to be telescopically received in and mounted relative to the drain hole, the insert sleeve having a body having a first surface, an opposed second surface and a central throughshaft extending from the first surface to the second surface, the first surface configured to be positioned proximate to the interior surface of the vessel, the insert sleeve further having at least one lateral shaft connected to the throughshaft and configured to receive a projecting element of a suitable mechanical closure mechanism therethough, the lateral shaft to the insert sleeve at a location proximate to the lower region of the insert sleeve;

wherein the drain plug is configured to be telescopically received in the central throughshaft defined in the insert sleeve, the drain plug mechanism having a first end and an opposed second end and an outer body extending therebetween, the drain plug mechanism moveable between at least one first contacted position and a second expanded position, the drain plug mechanism comprising:

a seal member attached to the outer body at a location proximate to the first end of the drain plug and extending outward therefrom, the seal configured to sealingly engage the first surface of the insert sleeve when the drain plug is oriented in the first contracted position; and a connection member located on the second end of the body of the drain plug mechanism, the connection member configured to be releasably engage the at least one lateral element associated with the drain closure mechanism, the lateral element moveably extending relative to the lateral shaft to moveably position the drain plug mechanism in either the first expanded position or the second contracted position.

18. The drain closure device of claim 16 wherein the connection member of the drain plug has at least one lateral slot configured to engage the terminal end of the lateral shoulder, the lateral slot having a width greater than the thickness of the lateral shoulder.

19. The drain closure device of claim 18 wherein the connection member further defines an entry slot in angular communication with the lateral slot, the entry slot having a width greater than the width of the lateral shoulder.

20. The drain closure device of claim 17 wherein the connection member further defines a terminal wall located in the lateral slot at a location distal to the entry slot.

21. The drain closure device of claim 17 wherein the drain plug further comprises at least one shoulder member connected to the drain plug mechanism body at a location proximate to the second end, the drain plug shoulder member extending outward from the drain plug shoulder member.

* * * * *